US007665686B2

(12) United States Patent
Becker et al.

(10) Patent No.: US 7,665,686 B2
(45) Date of Patent: Feb. 23, 2010

(54) DISPENSER

(76) Inventors: Elizabeth Fredericka Becker, Plot 28 Heidelberg Road, Homelands, Vereeniging 1939 (ZA); Beverly Gail Van Wyk, Plot 30 Heidelberg Road, Homelands, Vereeniging 1939 (ZA)

( * ) Notice: Subject to any disclaimer, the term of this patent is extended or adjusted under 35 U.S.C. 154(b) by 208 days.

(21) Appl. No.: 11/325,397

(22) Filed: Jan. 3, 2006

(65) Prior Publication Data

US 2006/0175462 A1 Aug. 10, 2006

(51) Int. Cl.
*B65H 49/00* (2006.01)

(52) U.S. Cl. ..... 242/588.2

(58) Field of Classification Search ..... 242/422.4, 242/422.9, 588.2

See application file for complete search history.

(56) References Cited

U.S. PATENT DOCUMENTS 4,484,717 A * 11/1984 Goldstein ..... 242/422.1
6,398,150 B1 * 6/2002 Munter et al. ..... 242/405.2

FOREIGN PATENT DOCUMENTS

GB 2 203 726 * 10/1988

* cited by examiner

*Primary Examiner*—William A Rivera
(74) *Attorney, Agent, or Firm*—Christie, Parker & Hale, LLP.

(57) ABSTRACT

A dispenser is described for a roll of cling wrap wound on a paper core (the "wrap core'), The dispenser comprises a main paper core which fits in the wrap core in such a way that the wrap core can rotate thereabout. A handle portion in the form of a paper core is wrapped around the main core on one side of the wrap core and a stop member formed of the same paper core is wrapped around the end section. The wrap core is held in position between the handle section arid the stop member. When the cling wrap has been fully used, the user disposes of the dispenser.

3 Claims, 3 Drawing Sheets

Figure 2:
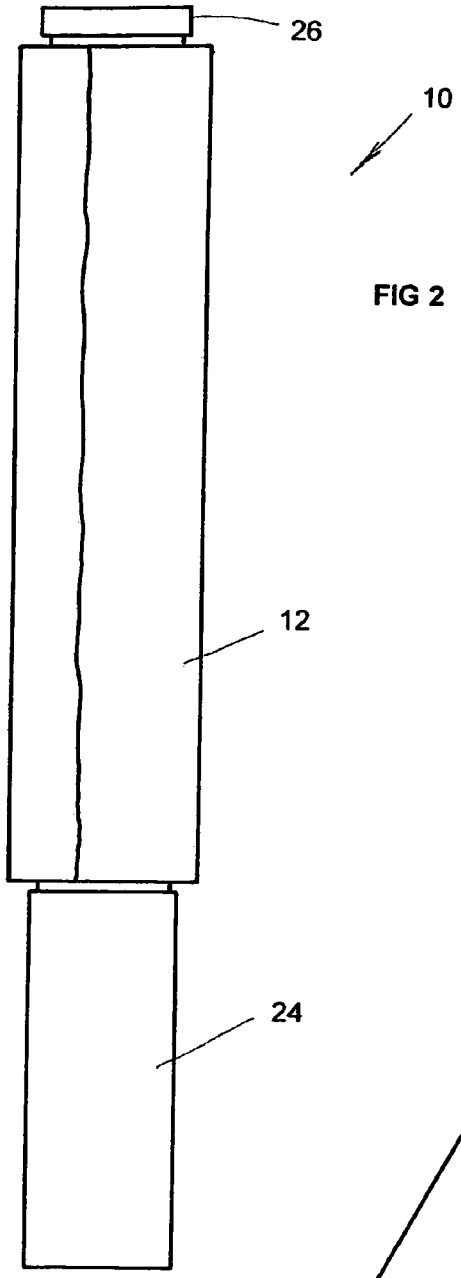

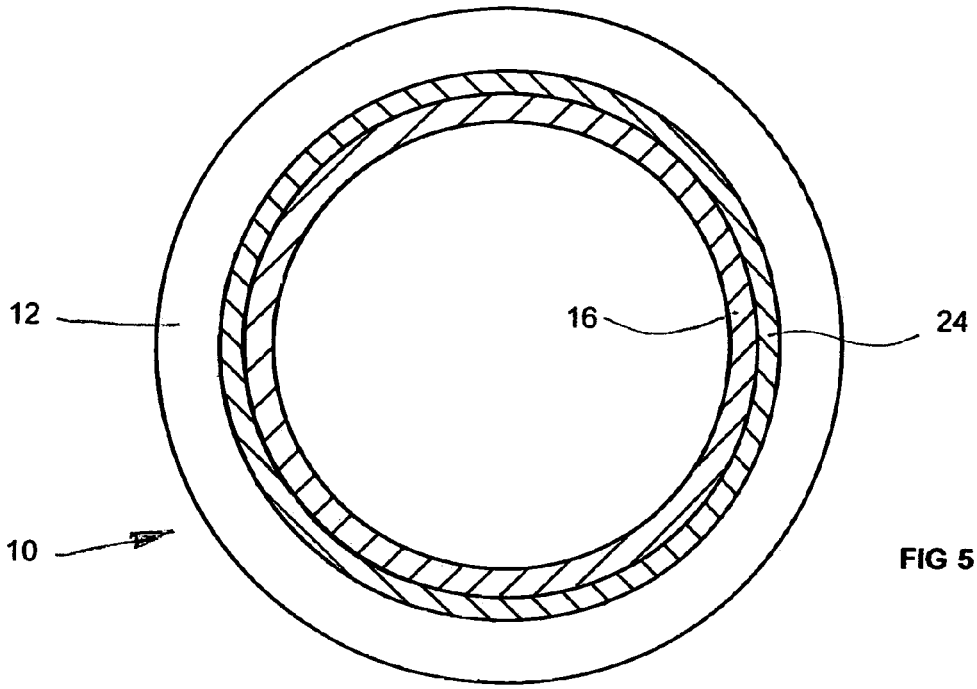
FIG 5
FIG 6
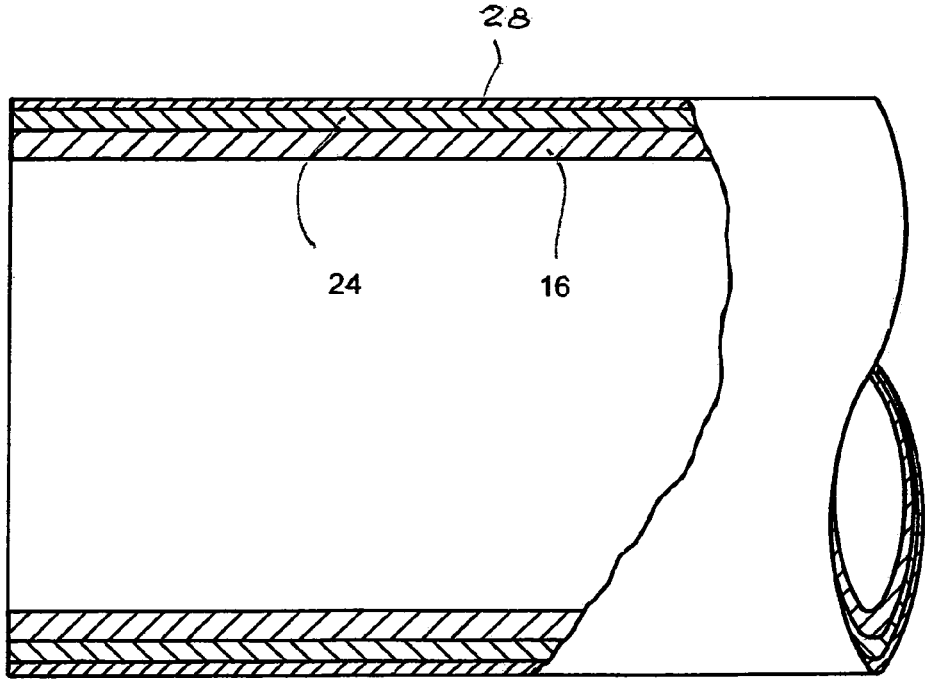

DISPENSER

CROSS-REFERENCE TO RELATED APPLICATIONS

PRIORITY CLAIM: 35 U.S.C. 119(a) Pursuant to 35 U.S.C. 119(a), this application claims the priority of South African Patent Application No. 2005/01143, filed on Feb. 7, 2005.

FIELD OF THE INVENTION

This invention relates to dispensers for a thin plastic wrapping material known as cling wrap or shrink wrap film (the term "cling wrap" will be used for this material in this specification).

BACKGROUND OF THE INVENTION

Cling wrap is sold in a roll wrapped around a hollow core (the "wrap core"). One form of cling wrap which is available in the United States is sold under the name Saran Wrap, which is polyvinylidene chloride film produced by The Dow Chemical Company. Cling wrap is a particularly satisfactory form of wrapping material having the ability to adhere to itself so that it can easily be wrapped around an article to be covered, However a disadvantage of cling wrap is that it will adhere to itself even when it is not intended that it should do so, and in particular if it folds or creases and it is often difficult thereafter to flatten out the cling wrap for use.

For industrial and commercial uses there are a variety of apparatus provided to enable the cling wrap to be unwound from the roll in a flat condition so that it can then be wrapped around whatever it is intended to protect, Such apparatus for dispensing the cling wrap in domestic use is not widely available, One item to our knowledge exists. It comprises a molded plastic handle having a spindle portion which is shaped to pass through the wrap core and to permit the wrap core to rotate thereabout. When the cling wrap has been fully used, the wrap core is removed and a fresh roll of cling wrap is placed on to the dispenser. Although this works quite satisfactorily, the cost of the holder is quite significant and this makes the cost of the entire product less attractive.

STATEMENT OF THE INVENTION

According to one aspect of the invention there is provided a dispenser for cling wrap comprising a wound paper core which is dimensioned to fit within the wrap core of the roll so that the wrap core can rotate thereabout, a handle by which the dispenser may be held and manipulated and a stop, the handle and stop being positioned so that a wrap core can be located therebetween and be held against axial movement thereby.

Preferably the dispenser core comprises a spindle portion which fits in the wrap core, a handle portion on one side of the spindle portion and constituting a handle means and an end portion on the other side of the spindle portion, carrying a stop means.

The handle means preferably further includes a handle liner which preferably comprises a wound paper or cardboard core that surrounds the handle portion and is secured thereto, and which acts as a stop to limit the axial movement of the roll away from the end portion. Especially for larger rolls of cling wrap the end portion may carry a second handle liner which acts as the stop means. Usually, however, the stop means comprises a short cardboard core which fits closely on to the end portion of the dispenser core.

A protective layer of material is preferably provided surrounding the or each handle liner.

According to another aspect of the invention there is provided the combination of a dispenser as set out above with a roll of cling wrap wound about a wrap core, wherein the wrap core is rotatably mounted on the spindle portion of the dispenser core and is held against secondary stop means which preferably fits around the dispenser core at the end thereof which is opposite from the handle and of the dispenser core.

Two embodiments of the invention will now be described by way of example with reference to the accompanying drawings.

SHORT DESCRIPTION OF THE DRAWINGS

In the drawings:—

Figure 1:
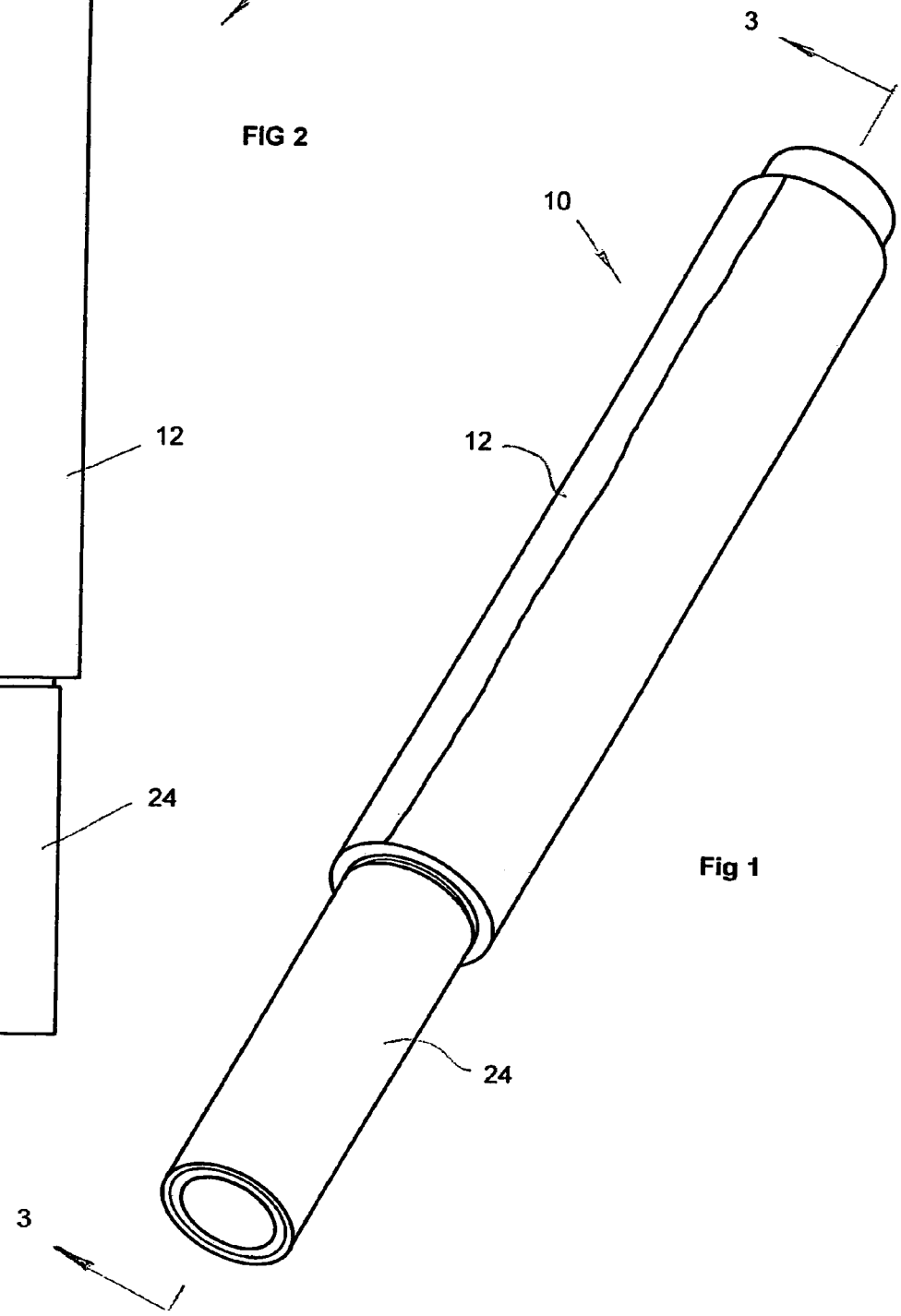
Figure 3:
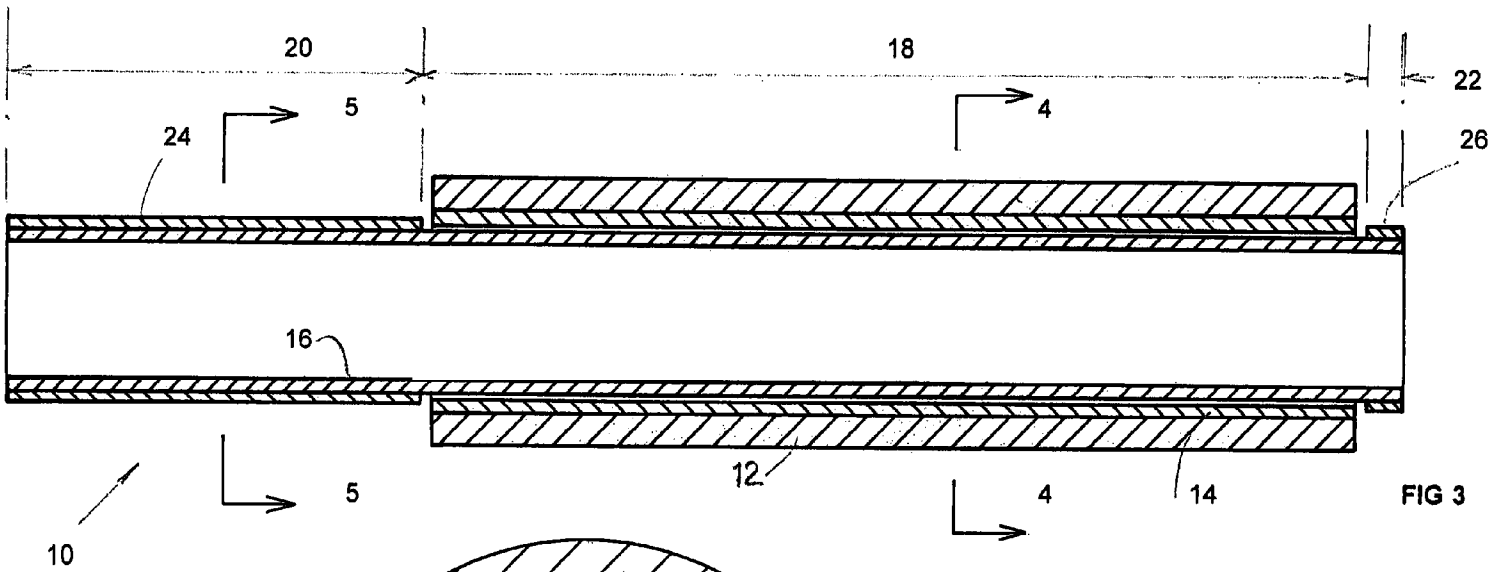
Figure 4:
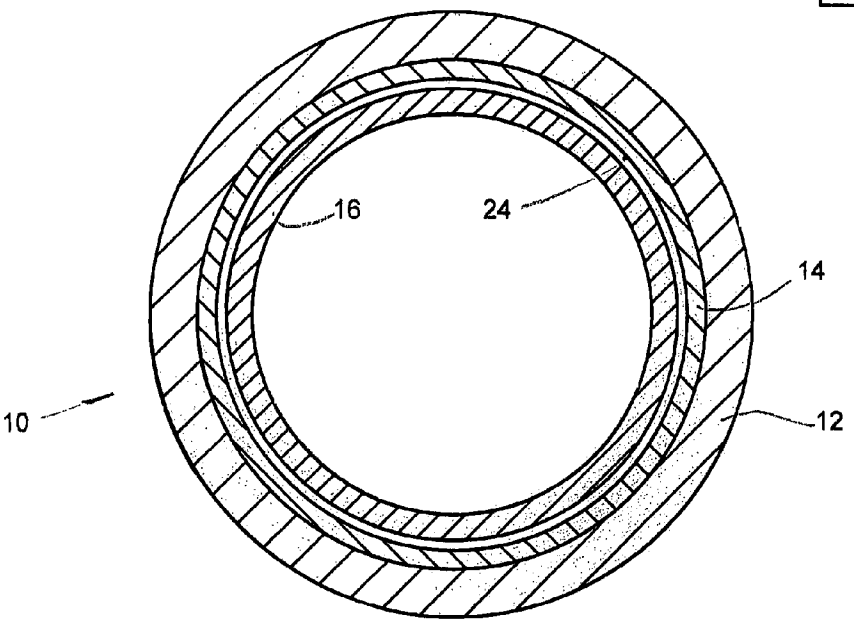

FIG. 1 is a perspective view of the combination of the invention comprising a dispenser with a roll of cling wrap thereon, FIG. 2 is side view of the combination, FIG. 3 is a longitudinal section through the combination along line 3-3 of FIG. 1, FIGS. 4 and 5 are respectively sections along lines 4-4 and 5-5 of FIG. 3, and FIG. 6 is longitudinal section through the handle section of a second embodiment of the invention.

DESCRIPTION OF THE INVENTION

Referring now to the drawings there is shown a dispenser 10 for use in dispensing cling wrap from a roll 12 that is wound around a wound paper core 14 (hereinafter called the "wrap core").

The dispenser 10 comprises an elongated hollow wound paper core 16. The axial length of the dispenser core 16 can be and preferably is longer than the wrap core 14. It comprises a spindle portion 18, a handle portion 20 on one side thereof and a short end portion 22 on the other end thereof.

The outside diameter of the dispenser core 16 is slightly less than the inside diameter of the wrap core 14 so that there is annular space therebetween. The spindle portion 18 defines a round cylindrical shaft which fits in the wrap core 14 which can now rotate thereabout, Fitted on to the handle portion 20 is a handle liner 24 preferably in the form of a wound paper core. The inside diameter of the handle liner 24 is only slightly greater than the outside diameter of the dispenser core 16. The outside diameter of the handle liner 24 is slightly less than the outside diameter of the wrap core 14. The handle liner 24 is secure to the handle portion as by means of a bonding medium.

An end stop 26 fits on to the end portion 22 of the dispenser core 16 and preferably is secured thereto as by a bonding medium. The end stop 26 can be comprised by a short section of the same core material from which the handle liner 24 is formed, so that its radial dimensions are the same as those of the handle liner 24.

In order to use the dispenser 10, with the roll of cling wrap carried thereon, it is brought to the item which is to be covered. A length of cling wrap is unwound from the roll and is wrapped around the item to be covered. In practice, by suitably manipulating the dispenser, it will be possible easily to unwrap the cling wrap in a continuous sheet without any wrinkles or creases and to wind it, or otherwise apply it, without difficulty on to the item to be covered. The used length of material is parted from the roll 12 in any known manner. After use of each length of cling wrap the remainder stays properly wrapped on the core ready for further use.

Once the cling wrap has been completely used the entire dispenser can be thrown away.

All the cores noted above preferably are wound paper cores of the kind well known. In a preferred embodiment of the invention as described above, the cling wrap is 245 mm wide and has a length of 50 meters. The inside diameter of the wrap core 14 is 38.0 mm and its outside diameter is 41.6 mm. The dispenser core 16 is 370 mm long. The length of the handle portion 20 is 110 millimeters and the length of the end portion 22 is 11 mm. The length of the spindle portion 18 is 249 mm, i.e. slightly longer than the wrap core. The outside diameter of the dispenser main core 16 is 37.5 millimeters, its inside diameter is 32 millimeters. The handle liner 24 has an outside diameter of 41.5 millimeters and an inside diameter of 38.5 millimeters.

It will be seen from the above that the handle liner 24 and end stop 26 will hold the wrap core 14 properly located. Furthermore the wrap core can easily rotate about the dispenser core for the purpose of withdrawing the cling wrap from the roll.

Reference is now made to FIG. 6, which depicts a second embodiment of the invention. The dispenser there shown is identical to that described above save that a moisture barrier 28 is applied to the handle liner 24 to protect it if the hands of the user are wet or contain other contaminant. The moisture barrier can be provided as a sleeve or layer of wax barrier paper, e.g.

We have found that by making the dispenser of tubular cores as described above the dispenser can be very inexpensively made so that the entire unit, i.e., the dispenser plus the roll of cling wrap, can be sold inexpensively. Thus the product is disposable and once the cling wrap has been used up the user may dispose of the dispenser.

The invention is not limited to the precise constructional details hereinbefore described and illustrated. For example, the various dimensions can alter as desired and/or as dependent upon the size of the cling wrap to be dispensed. Where the roll comprises a much larger length of cling wrap, say 330 meters, the dispenser core may be made significantly longer than the length of the coil so that there are handle portions on both sides of the wrap core; each handle portion functions as a stop for maintaining the wrap core properly positioned between the handle portions. Both such handle portions may have handle liners, which are preferably identical, and are as described above. The protective layer on the handle means may comprise any other suitable material,

What is claimed is:

1. A roll of cling wrap with a supporting dispenser comprising

A a roll of cling wrap including a tubular wrap core and a length of cling wrap wound around the wrap core over essentially the entire length of the wrap core, and B a dispenser rotatably supporting the roll and comprised of 1) a tubular support core of wound paper consisting of a) a spindle portion disposed within the wrap core and dimensioned such that the wrap core can rotate thereabout, b) a handle portion which extends from one side of the spindle portion and projects beyond the wrap core, and c) an end portion which extends from the other side of the spindle portion and projects beyond the wrap core, 2) a handle comprising a wound paper core surrounding and affixed to the handle portion of the support core and radially dimensioned to limit movement of the wrap core in one direction along the support core, and 3) a stop comprising a wound paper core surrounding and affixed to the end portion of the support core and being radially dimensioned such as to limit movement of the wrap core in a second opposite direction along the support core and to prevent the wrap core from being removed from the spindle portion of the support core.

2. Apparatus according to claim 1 in which the length of the stop core and of the support core surrounded by the stop core is insufficient in extent to enable the stop core and adjacent support core to be used effectively as a handle.

3. Apparatus according to claim 1 in which the length of the stop core and of the support core in its end portion is a minor part of the length of the handle core.

* * * * *